US005598862A

United States Patent [19]

Cain et al.

[11] Patent Number: 5,598,862

[45] Date of Patent: Feb. 4, 1997

[54] UMBRELLA HANDLE

[75] Inventors: Ann S. Cain, Cincinnati, Ohio; David E. Burbrink, Ft. Thomas, Ky.

[73] Assignee: 'totes', Incorporated, Loveland, Ohio

[21] Appl. No.: 530,481

[22] Filed: Sep. 19, 1995

[51] Int. Cl.[6] ..... A45B 25/14

[52] U.S. Cl. ..... 135/24; 135/25.41

[58] Field of Search ..... 135/22–24, 25.4, 135/25.41, 72, 76, 65

[56] References Cited

U.S. PATENT DOCUMENTS

| | | | |
|---|---|---|---|
| 4,616,868 | 10/1986 | Okuda . | |
| 4,624,276 | 11/1986 | Allen . | |
| 4,930,533 | 6/1990 | Allen . | |
| 4,986,294 | 1/1991 | Wu | 135/22 |
| 4,989,625 | 2/1991 | Wu | 135/22 |
| 5,078,165 | 1/1992 | Wu | 135/25.1 X |
| 5,080,118 | 1/1992 | Allen . | |
| 5,144,969 | 9/1992 | Chou et al. | 135/22 |
| 5,178,174 | 1/1993 | Wu | 135/25.4 X |
| 5,186,197 | 2/1993 | Lavine | 135/25.1 X |
| 5,275,186 | 1/1994 | Liu | 135/25.4 X |
| 5,390,686 | 2/1995 | Lin et al. | 135/24 |
| 5,458,144 | 10/1995 | Lavine | 135/25.1 X |

*Primary Examiner*—Lanna Mai

*Attorney, Agent, or Firm*—Wood, Herron & Evans, P.L.L.

[57] ABSTRACT

An umbrella handle assembled from an inner sleeve fixed to the umbrella's centerpost, and a handle shell seated on that inner sleeve. The sleeve and shell each have a respective latch bores that are aligned to allow a latch button accessible from the exterior surface of the shell to operate an umbrella latch mechanism carried interiorly of the centerpost.

2 Claims, 1 Drawing Sheet

UMBRELLA HANDLE

This invention relates to umbrellas. More particularly, this invention relates to an improved umbrella handle.

An umbrella is basically comprised of a rib linkage system connected to one end of an umbrella centerpost, and a handle connected to the other end of that centerpost. A cover is stretched over the rib linkage system. The cover is opened and closed, i.e., the umbrella is erected and collapsed, as rib linkages of the rib linkage system are extended radially outward from the centerpost, and then retracted against the centerpost. In recent years, umbrellas with collapsible centerposts have become common in the marketplace. These collapsible centerpost umbrellas are quite useful for those users who wish to carry the umbrellas in, e.g., briefcases, handbags or the like. And also in recent years, umbrellas have become common in the marketplace which automatically open. An automatic openable umbrella is operated by a spring motor mechanism contained interiorly of the umbrella's centerpost. And the automatic opening spring motor mechanism is controlled by a latch button provided on the umbrella's handle. Typical of such an automatic opening umbrella with latch control button on the umbrella's handle is that illustrated in U.S. Pat. No. 5,020,558. Also in this regard, and although not particularly common in the marketplace, there are spring motor mechanisms for umbrellas known which automatically open the umbrella and also which automatically close the umbrella. Again these automatic opening/automatic closing umbrellas are operated by a latch control button provided on the umbrella's handle. An umbrella with an automatic opening/automatic closing motor mechanism is illustrated in U.S. Pat. No. 5,390,686.

Now as mentioned, it is commonplace that the latch operator button for an automatic opening umbrella, and for an automatic opening/automatic closing umbrella, be incorporated with the umbrella's handle. It is important in this regard that the latch operator button be movable, e.g., in a perpendicular direction relative to the centerpost's longitudinal axis and/or in a rocking motion on a rocker axis perpendicular to the centerpost's longitudinal axis, and that there be no interference between the latch button's motion relative to the handle and the handle itself. This for the reason that the latch mechanism which controls the automatic opening motor mechanism, and where used the automatic closing motor mechanism, incorporated in the umbrella is a relatively close tolerance mechanism. And it is quite desirable that the latch operator button be freely operable, i.e., be free of any outside hindrance such as friction with the umbrella's handle, when called upon to perform its function of activation to automatically open or automatically close, as the case may be, the respective opening mechanism and/or closing mechanisms for the automatic umbrella. In this regard, however, and particularly when the umbrella handle is made of certain materials such as, for example, wood, it is difficult to form the handle with sufficiently close tolerance limits as is desired when the umbrella handles are manufactured on a mass produced basis.

Accordingly, it has been the primary objective of this invention to provide an improved umbrella handle comprised of an inner sleeve fixed to the umbrella's centerpost, and a handle shell seated on that inner sleeve. The sleeve and shell each have respective latch bores that are aligned to allow a latch button accessible from the exterior surface of the shell to operate an umbrella latch mechanism carried interiorly of the centerpost.

It has been another objective of this invention to provide an improved umbrella handle which incorporates an inner sleeve structure where close tolerance control can be maintained in order to provide stabilization for the umbrella's automatic opening latch mechanism relative to the operator pushbutton on the handle required to operate it, and which also accommodates itself to the use of numerous different handle shells each of varying aesthetic designs in order to provide a singular base on which handle can be fabricated for installation on the umbrella's centerpost.

These and other objectives will be more apparent from the following detailed description taken in conjunction with the drawings in which.

A preferred embodiment of an umbrella handle in accord with the principles of this invention is illustrated in the figures.

Figure 2:
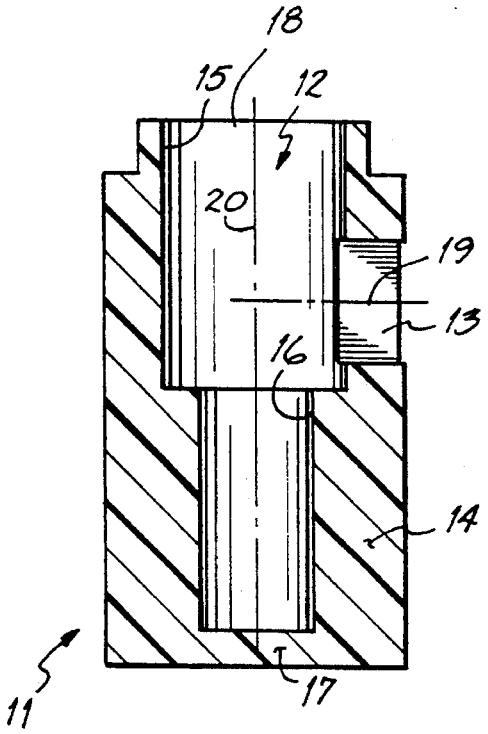
FIG. 2 is a cross-sectional view of a handle shell for an umbrella handle in accord with the principles of this invention.

The umbrella handle 10 is comprised of a handle shell 11 having a longitudinal bore 12 defined interiorly thereof, as particularly illustrated in FIG. 2. The handle shell 11 includes a latch button hole 13 defined in a side wall 14 thereof. The latch button hole 13 extends through the shell's side wall 14 into the shell's longitudinal bore 12. In preferred form, and particularly as shown in FIG. 2, the shell's longitudinal bore 12 is comprised of a large cross-sectional area section 15 and a small cross-sectional area section 16 which are coaxially oriented. The small cross-sectional area section 16 of that longitudinal bore 12 is closed off at one end by the handle's end wall 17. And the large cross-sectional area section 15 of the shell's longitudinal bore 12 is open at its free end 18. Note particularly the shell's latch button hole 13 is located in a side wall of the large cross-sectional area section 15, and is oriented on an axis 19 perpendicular to the longitudinal axis 20 of the shell's longitudinal bore 12.

Figure 1:
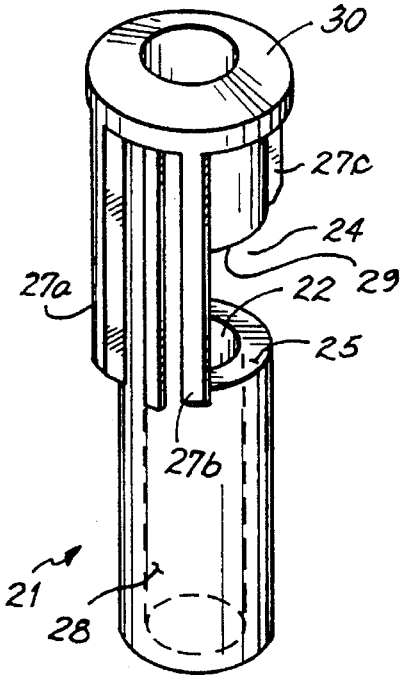
FIG. 1 is a perspective view of a sleeve for the umbrella handle in accord with the principles of this invention.
Figure 3:
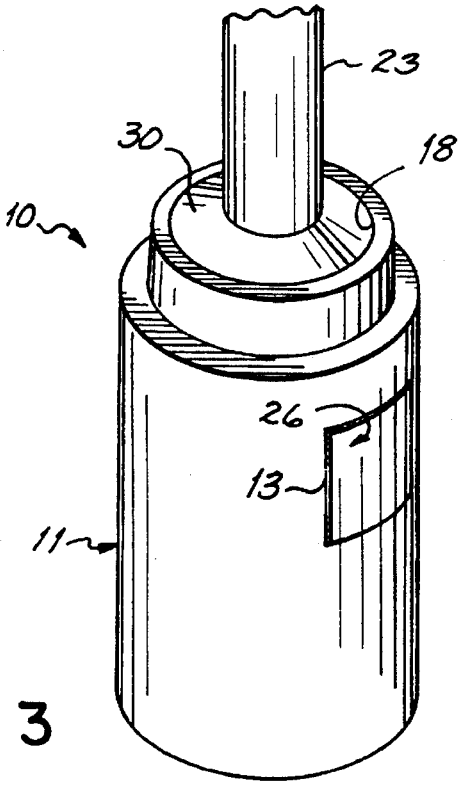
FIG. 3 is a perspective view of the umbrella handle's sleeve and the umbrella handle's shell in assembly, along with an operator pushbutton for the umbrella's automatic opening mechanism (not shown).

The umbrella handle 10 also is comprised of an inner sleeve 21 as particularly illustrated in FIG. 1. The sleeve 21 is seated in the longitudinal bore 12 of the handle shell 11 upon assembly of those two components. The sleeve 21 includes a longitudinal bore 22 adapted to receive an umbrella's centerpost 23 in fixed assembly therewith. In other words, the sleeve's longitudinal bore 22 is configured and sized in cross section so that the handle end of the umbrella's centerpost 23 can be received therein and fixed thereto by means not shown. The handle's sleeve 21 also includes a latch button hole 24 defined in a side wall 25 thereof. This sleeve latch button hole 24 is aligned with the shell latch button hole 13 when the sleeve and handle are assembled, as illustrated in FIG. 3. The sleeve latch button hole 24 and the shell latch button hole 13 allow a latch button 26 accessible from the exterior surface of the shell to operate an umbrella handle latch mechanism carried interiorly of the centerpost 23. A typical self opening umbrella with a spring operated motor mechanism, and with a button latch 26 for operating that self opening mechanism which is located on the umbrella's handle, is illustrated in U.S. Pat. No. 5,020,558 issued Jun. 4, 1991. The disclosure of that patent is incorporated by reference in this application.

As shown in FIG. 1, the handle's sleeve includes plural spacer ribs 27 (three being illustrated in the figures) fixed longitudinally to the sleeve. The spacer ribs 27 function to orient substantially co-axially the sleeve 21 and the shell 11 when the two are assembled one with the other. Note particularly that two 27*a*, 27*b* of these spacer ribs run down that solid back wall section 28 of the sleeve 21 which remains after the sleeve latch button hole 24 has been formed therein. The third 27*c* of the three spacer ribs shown in the sleeve as illustrated runs only to the top edge 29 of that latch button hole 24. Accordingly, the two ribs 27*a*, 27*b* that extend down the back wall section of the sleeve latch button hole 24 function to enhance the structural stability of the sleeve 21 in the area of that sleeve latch button hole. The sleeve 21 itself also includes a cap 30 at the sleeve's top end. This cap 30 is sized to close off the large diameter section 15 of the handle shell's longitudinal bore 12 when the sleeve 21 and shell 11 are connected in final assembly.

The advantages of this umbrella handle 10 invention relative to the prior art are several. And this is particularly so when the umbrella handle shell 11 is formed from wood where dimensional tolerance control is more difficult. First, and importantly, when the handle sleeve 21 is formed from a plastic (the tolerance limits of which can be closely controlled) and when the handle shell 11 is formed from a wood (where the tolerance limits of the bore 12 and hole 13 cannot be as closely controlled), the resulting umbrella handle 10 provides significant stabilization for the latch operator button 26 which controls the latch mechanism (not shown) for the umbrella's automatic opening mechanism (not shown). This for the reason that the latch button 26 basically cooperates with the latch button hole 24 in the handle's sleeve 21, and since that sleeve component is formed of a plastic which can be molded to close tolerances there is effective stabilization which results for the latch mechanism (not shown) and the pushbutton mechanisms. Second, and also importantly, it will be apparent that the exterior aesthetic design of the handle shell 11 can be modified and changed in any of numerous ways in order to provide any final exterior aesthetic design for the umbrella handle 10 that may be desirable for the retail consumer market. In other words, handle shells 11 with any number of different exterior aesthetic designs can be used with the single sleeve 21 component illustrated in FIG. 1 to provide a plurality, if not indeed a multiplicity, of final exterior handle designs for the retail consumer market. This provides simplicity in manufacturing and reduces end costs particularly where the handle shells 11 are fabricated from wood as aforementioned.

Having described in detail the preferred embodiment of my invention, what I desire to claim and protect by Letters Patent is:

1. An umbrella handle comprising a handle shell having a longitudinal bore defined interiorly thereof, and having a latch button hole defined in a side wall thereof which extends through said side wall into said longitudinal bore, an inner sleeve seated in said longitudinal bore of said handle shell, said sleeve having a longitudinal bore adapted to receive an umbrella centerpost in fixed assembly therewith, and said sleeve having a latch button hole defined in a side wall thereof which is aligned with said shell latch button hole, said sleeve and shell latch button holes allowing a latch button manually accessible from the exterior surface of said shell to operate an umbrella latch mechanism carried interiorly of said centerpost a cap fixed to said sleeve, said cap being sized to close off one end of said shell's bore, and plural spacer ribs fixed longitudinally to said sleeve, said spacer ribs functioning to orient said sleeve and said shell substantially coaxially, and at least one of said spacer ribs functioning to enhance the structural stability of said sleeve in the area of said sleeve's latch button hole.

2. An umbrella handle as claimed in claim 1, said shell having large and small cross-sectional area longitudinal bore sections, said shell's latch buttonhole being located in a side wall of said large cross-sectional area longitudinal bore section, and said sleeve ribs abutting the interior surface of said large cross-sectional area longitudinal bore section.

* * * * *